United States Patent [19]

Gentry et al.

[11] Patent Number: 5,070,552

[45] **Date of Patent: * Dec. 10, 1991**

[54] PERSONALIZED HAND HELD SHOWER HEAD

[75] Inventors: Jefferson L. Gentry, Deerfield, Ill.; Alfons Rundzaitis, Beverly Shores, Ind.

[73] Assignee: Associated Mills, Inc., Chicago, Ill.

[ * ] Notice: The portion of the term of this patent subsequent to Jun. 10, 2007 has been disclaimed.

[21] Appl. No.: 306,627

[22] Filed: Feb. 3, 1989

[51] Int. Cl.[5] ..... A47K 3/22

[52] U.S. Cl. ..... 4/615; 4/559; 4/605; 4/606; 4/567; 239/559

[58] Field of Search ..... 4/615, 606, 605, 559, 4/567, 597, 596, 600, 604; 128/56; 239/559, 443, 394, 390, 391, 449, 397

[56] References Cited

U.S. PATENT DOCUMENTS 843,260 2/1907 Cloud ..... 4/615
1,358,733 11/1920 Heine ..... 4/606
1,840,812 1/1932 Hardy ..... 4/615
3,921,635 11/1975 Gauthier ..... 4/615
4,413,362 11/1983 Chianco et al. ..... 4/615 X

FOREIGN PATENT DOCUMENTS 284763 10/1988 European Pat. Off. ..... 4/615
3601035 8/1987 Fed. Rep. of Germany ..... 4/615

*Primary Examiner*—Henry K. Artis
*Attorney, Agent, or Firm*—Laff, Whitesel, Conte & Saret

[57] ABSTRACT

A hand held shower head especially—but not exclusively—for personal use has a porous sponge removably clamped over the holes from which a water spray normally issues. The sponge converts the spray into a flowing cascade of water. The sponge is changeable so that each user may have a clean surface, as he sees fit or so that different spray characteristics may be achieved. An arrangement is provided for hanging up the sponge if a user wishes to use the shower with the spray instead of with the cascading flow of water.

9 Claims, 1 Drawing Sheet

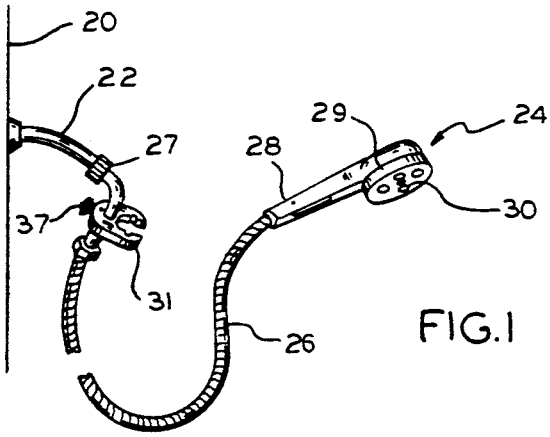
FIG.1
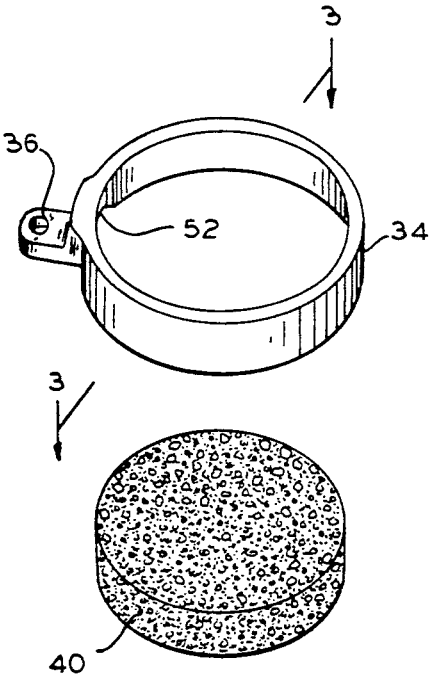
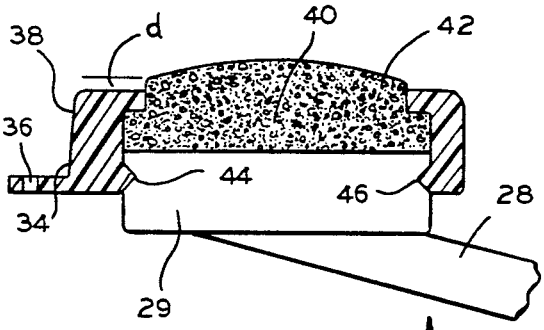
FIG.3
FIG. 2
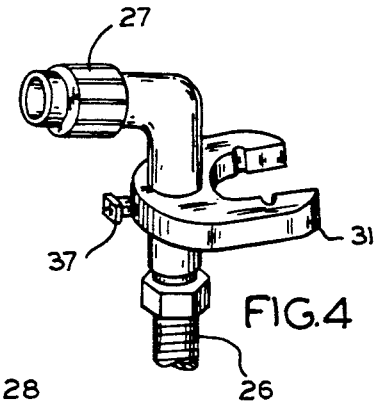
FIG.4
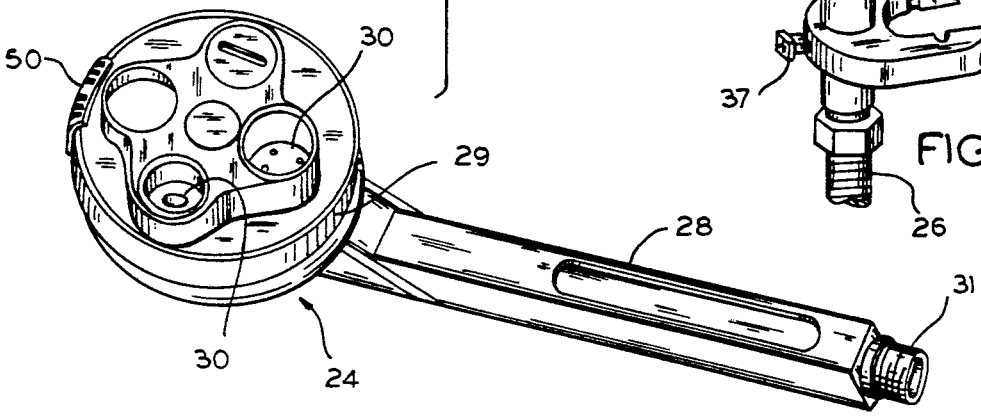

PERSONALIZED HAND HELD SHOWER HEAD

This invention relates to shower heads and more particularly to personalized, hand held shower heads.

While the invention is herein shown and described in connection with hand held shower heads for personal use, it should be understood that the invention may also find use on other types of shower heads. For example, there may be places where a conventional overhead shower head should have a cascade of water instead of a spray. Some kitchen sink faucets may be better adapted to their intended use when they have a dish-washing spray head with a cascade of water issuing therefrom, especially when the spray head is covered by a sponge having abrasive material embedded therein. Accordingly, as used herein, the term "shower head" should be given a meaning which is broad enough to cover all of these and similar devices.

Two types of shower heads are currently available for a personal bath use. The first type is a shower head attached directly to a plumbing pipe which permanently projects from a wall, or the like, at a height which is higher than the head of most persons. The second type is a shower head which is attached to a rubber or other flexible hose leading to a plumbing fitting. In the United States, the first type of shower head is usually removed and the free end of the rubber hose is attached in lieu of the removed shower head. In other countries, there often is a provision for attaching the rubber hose to a plumbing outlet in another manner.

The first type of shower head is usually enclosed by either a shower curtain or a shower stall. The water may spray out from the shower head in any direction without harm because it is captured and contained by the curtain or stall. Moreover, since the shower head is overhead and fairly remote, nothing picked up from the body of one person may be carried over to the body of another person who next uses the shower. Thus, the first type of shower head is quite sanitary.

The second and hand held type of shower head is held close to the user's body so that the spray is deflected and blocked by the body of the user. Very often, this type of shower head is used without any enclosure such as a shower curtain or stall. If the shower head is not pointed directly toward the body of the user or if the water is turned up too high, the spray may miss the body of the user and impinge upon some nearby object which is wetted in an unwanted manner. Also, the hand held shower head may touch the body of one user where it could pick up germs or some other contaminants, for example, which could be passed on to the next user.

Another use of a hand held shower head is to give shampoos in beauty parlors and barber shops. If the person holding the hand held shower head is not very careful, another and nearby patron may receive an impromptu shower. Also, since the shower head is usually held against the scalp in order to avoid such an impromptu shower, it may be possible to transmit germs from the scalp of one patron to the scalp of the next patron.

Still other considerations in the use of a hand held shower head will readily occur to those who are skilled in the art.

Accordingly, an object of the invention is to provide new and improved general purpose shower heads having a great variety of different uses. Here, an object of the invention is to provide a shower head having an optional use with either a conventional spray or an unconventional cascading flow.

A further object is to provide sanitary shower heads which do not pass contaminants from one user to the next. In this connection, an object is to provide a hand held shower head which may be rubbed directly upon the user's body.

Another object of the invention is to provide hand held shower heads which do not issue unwanted spray onto nearby objects even if the head is pointed in the wrong direction or if it is held too far from the user's body.

Yet another object of the invention is to provide a sanitary hand held shower head for use in public places, such as at beauty parlor and barber shop shampoo sinks, dormitories, army barracks, or the like.

In keeping with an aspect of the invention, these and other objects of the invention are accomplished by providing a removable sponge which is held in place over the shower head by means of a clip-on retaining ring. The sponge converts a spray issuing from the shower head into a cascade of water which flows smoothly, but without the energy required to travel over any considerable distance. A new sponge and snap ring may be provided for each person who uses the hand held shower head, especially in a public place. For family use, the sponges may be color coded for identifying the individual sponge used by each member of the family.

A preferred embodiment of the invention is seen in the attached drawings, wherein:

FIG. 1 shows a hand held shower head;

FIG. 2 is an exploded view, in perspective, showing the invention and a shower head;

FIG. 3, partially in cross section taken along line 3—3 in FIG. 2, shows the inventive parts assembled on the hand held shower head of FIG. 1; and FIG. 4 is a perspective view of a connector at the distal end of a rubber hose.

There are many hand held shower heads, few of which are exemplified by U.S. Pat. Nos. 245,855 through 245,860, all issued Sept. 20, 1977, and by U.S. Pat. Nos. 3,998,390 and 4,165,837, for example.

In general, a suitable support structure 20 (FIG. 1) (such as a wall) has a faucet or other plumbing fitting 22 associated therewith. Any suitable drain, sink, tub or the like (not shown) may be positioned nearby in order to collect and drain away the water issuing from the faucet. The hand held shower head 24 is coupled to the faucet or fitting 22 by a rubber or other flexible hose 26 having a distal end which is attached thereto in any suitable manner. By way of example, FIG. 1 has been drawn to show that a conventional shower head has been removed and replaced by a coupler or nut 27 on the distal end of the rubber hose 26 leading to the hand held shower head 24.

The shower head generally has a handle 28 (FIG. 2) and a spray head 29 with a suitable number holes 30 therein for water to pass through. A conduit beginning at a threaded end coupler 31 extends through the handle 28 to the spray head 29 in order to convey water thereto. The pressure of water in the system leading to faucet 22 causes water to spray a considerable distance out of the holes 30. Sometimes a valve (not shown) may be associated with the handle 28 in order to control the flow of water from the head. Sometimes a hook 31

(FIG. 1) is provided to hang up the shower head 24 when it is not in use.

According to the invention, a retaining ring 34 is shaped and proportioned to fit preferably with some friction over the exterior of the spray head 29. The retaining ring has a hole 36 formed therein to provide means for hanging it, when not in use. If the retaining ring, shower head, and distal end connector are designed as a unit, a pin 37 may be placed on or near nut 27 to receive hole 36 in order hang up the retainer ring and sponge assembly. The peripheral edge of ring 34 should be rounded, as best seen at 38 (FIG. 3), so that it cannot scrape the skin of the user.

A sponge 40 is shaped to fit snugly inside the retaining ring 34. Therefore, when the retaining ring 34 is in place on spray head 29, the sponge 40 provides an exposed surface 42 which may be rubbed over the body of the user. Therefore, by replacing the sponge, a new and clean surface may be presented to the user so that he will not have to share his cleaning surface 42 with another person. The sponges may be color coded so that each member of the family can recognize his own sponge.

The sponge 40 may be made of any suitable material, either synthetic or natural. Preferably, the sponge should be thick enough to project some distance d above the surface of the retaining ring 34 so that only the surface of the sponge touches the body of the user. The sponge 40 should be porous enough for water to flow freely through it, but should not be so porous that individual streams of water which pass through it issue from surface 42 with enough force to travel over extended distance. Instead, the water passing through the sponge should cascade freely over the body of the user. Therefore, even if the spray head 29 is pointed in the wrong direction, no one in its path will be treated to an impromptu shower.

The preferably friction fit between retaining ring 34 and spray head 29 should be tight enough so that the sponge is not dislodged with normal use. On the other hand, it should also be loose enough so that the sponge 40 may be removed by holding the ring 34 and pushing on the sponge. Also, preferably, a key or device 50 may protrude from the spray head 29. A complementary recess 52 may be formed in the retaining ring 34 in order to index the position of the retainer ring on the spray head. In some spray heads, the device 50 is a switch for selecting a form of spray.

If the ring and spray head are designed as a unit, there may be other means for securing the sponge on the spray head. For example, a bayonet mount may have projecting embossments which fit over recesses on the spray head and then are given a turn to lock together the ring 34 and spray head 29. Other attachment means may include screw threads or another suitable clamping means. Therefore, the term "connector" is used in the appended claims in a manner which is broad enough to cover any of these and other suitable means for securing the retaining ring 34 to the spray head 29.

An advantage of the invention is the alternatives which are provided for the user. He may remove the sponge and have a conventional shower. Then, he may replace the sponge and have a different kind of shower usage. It is also possible that different kinds of sponges may be provided to accommodate some different needs. One sponge may be very porous and have large pores. Another sponge may have tiny pores through which the water oozes. Thus, one person may wash a surface quickly and easily with the very porous sponge. Another person may provide a very soft and gentle wetting with the oozing water of a less porous sponge.

Those who are skilled in the art will readily perceive how to modify the invention. Therefore, the appended claims are to be construed to cover all equivalent structures which fall within the true scope and spirit of the invention.

The invention is claimed:

1. A shower head comprising a spray head having holes therein through which water may issue and travel as a spray for some extended distance, a porous material device fitting over said spray head for converting said issuing water into a cascading flow of water, and removable retaining means for selectively holding said material in place over said holes in said spray head, said retaining means being a ring forming a frame for holding said porous means, said ring fitting over said spray head and being held thereon by friction, whereby said shower head may be interchangeably used with either said spray or said cascade of said water said shower head being a hand held shower head for personal use and wherein said porous material device being a synthetic or natural sponge which has a thickness such that a surface of said sponge extends beyond the outermost surface of said retaining ring, said sponge extending far enough so that substantially only the surface of said sponge engages the body of a user during normal usage.

2. The shower head of claim 1 wherein said retaining means is a ring which fits over said spray head and is held in place by a connector.

3. The shower head of claim 1 wherein the exposed edges of said retaining ring are rounded so that they will not scrape the body of a user.

4. The shower head of either claim 1 or 2 and hanging means associated with said shower head and said retainer ring so that it may be hung-up when not in use.

5. The shower head of claim 4 and a flexible hose for conveying water to said spray head, and said hanging means includes a pin associated with a distal end of said hose for receiving said retainer ring when it is hung up.

6. The shower head of either claim 1 or 2 wherein said porous material contains an abrasive material.

7. The shower head of either claim 1 or 2 wherein said porous material device has any selected one of a plurality of porosities.

8. The shower head of claim 1 wherein there are a plurality of said porous material devices, each of the porous material devices being color coded, whereby each person who uses the shower may identify his own individual porous material device by color.

9. A hand held shower head comprising a flexible hose having one end attached to a handle with a spray head, a water conduit extending from said hose through said handle to said spray head, a coupler associated with an opposite end of said hose for introducing water thereto, a retaining ring forming a frame fitting over said spray head, said retaining ring being friction fit and held on said shower head two, means associated with said coupler said retaining ring having means for enabling said ring to be hung up on one of said two means when not in use the other of said two means supporting said handle when said spray head is not is use and while said spray head is being used, and porous sponge means removably held against said spray head by the frame formed by said retaining ring for converting said spray into a cascade of water.

* * * * *